US008713743B2

(12) United States Patent
Mell et al.

(10) Patent No.: US 8,713,743 B2
(45) Date of Patent: May 6, 2014

(54) HUB FLANGE FOR CAST HUB BRUSH

(75) Inventors: Larry Mell, Lake Ariel, PA (US); Liam Murtagh, Dickson City, PA (US)

(73) Assignee: Weiler Corporation, Cresco, PA (US)

( * ) Notice: Subject to any disclaimer, the term of this patent is extended or adjusted under 35 U.S.C. 154(b) by 2169 days.

(21) Appl. No.: 11/311,206

(22) Filed: Dec. 19, 2005

(65) Prior Publication Data

US 2007/0136969 A1 Jun. 21, 2007

(51) Int. Cl.
*A46B 15/00* (2006.01)
*A46B 1/00* (2006.01)

(52) U.S. Cl.
USPC ..... 15/192; 15/187

(58) Field of Classification Search
USPC ..... 15/179, 181, 183, 192, 193; 200/21; 51/298; 451/358, 490, 496, 508, 526, 451/541; 300/20
See application file for complete search history.

(56) References Cited

U.S. PATENT DOCUMENTS

| | | | | | |
|---|---|---|---|---|---|
| 1,402,990 | A * | 1/1922 | Adams | ..... | 15/179 |
| 1,706,159 | A * | 3/1929 | Herold | ..... | 15/181 |
| 2,000,612 | A * | 5/1935 | Radinse | ..... | 15/179 |
| 2,190,206 | A * | 2/1940 | Churchill | ..... | 15/179 |
| 3,137,020 | A * | 6/1964 | Tilgner | ..... | 15/179 |
| 3,172,141 | A * | 3/1965 | Arena | ..... | 15/192 |
| 3,281,882 | A * | 11/1966 | Charvat | ..... | 15/179 |
| 3,325,846 | A * | 6/1967 | Goss | ..... | 15/179 |
| 3,372,220 | A * | 3/1968 | Stingley | ..... | 264/236 |
| 5,108,155 | A * | 4/1992 | Hettes et al. | ..... | 300/21 |
| 5,518,794 | A * | 5/1996 | Barber et al. | ..... | 428/95 |
| 6,163,917 | A * | 12/2000 | Bown | ..... | 15/179 |
| 2002/0045416 | A1 * | 4/2002 | Shia et al. | ..... | 451/490 |

* cited by examiner

*Primary Examiner* — Lee D Wilson
*Assistant Examiner* — Jamal Daniel
(74) *Attorney, Agent, or Firm* — Drinker, Biddle & Reath, LLP

(57) ABSTRACT

The present invention is a rotary brushing tool and method of constructing the rotary brushing tool. The rotary brushing tool comprises a hub portion and a wheel portion. The hub portion has a pair of hub elements, where each hub element includes a central opening, an annular retaining plate portion that extends radially from the central opening, and a tubular portion that extends axially from the central opening. Placing the tubular portions of the hub elements in opposition forms a hub channel that extends radially from the central opening. The wheel portion includes bristles arranged in the hub channel to extend substantially radially from the central opening, and a castable material for retaining the bristles. Pouring the castable material into the hub channel and allowing it to cure, forms a hub that retains the bristles.

15 Claims, 2 Drawing Sheets

HUB FLANGE FOR CAST HUB BRUSH

FIELD OF THE INVENTION

The present invention relates, in general, to rotary brushing tools having non-woven bristles that extend radially from a central hub. In particular, the present invention encompasses a rotary brushing tool having non-woven bristles that extend radially from a central hub which is constructed to produce a one-piece integral structure with a consistent internal diameter.

BACKGROUND OF THE INVENTION

Rotary brushing tools are widely used in industry for cleaning, polishing, deburring, finishing, and burnishing metals and other materials. Rotary brushing tools having a one-piece integral hub structure are desirable because the structural rigidity of such tools will produce a finer surface finish and increase the life of the tool.

One way of making rotary brushing tools having a one-piece integral hub structure involves placing bundles of non-woven bristles in a fixture, pouring an epoxy or similar material to form the hub into a mold, and allowing the material to cure to form a finished hub. However, the curing characteristics of the material can change from batch to batch and even within the same batch given changes in environmental conditions such as temperature and humidity. These changes to the curing characteristics of the material cause the internal diameter of the hub to fluctuate and possibly be outside desired tolerances. If the internal diameter of the hub is too small, the hub will not fit on an arbor. If the internal diameter of the hub is too large, the brush will just spin idly on the arbor. Either way, when the internal diameter of the hub fails to meet desired tolerances, the brush is essentially useless.

SUMMARY OF THE INVENTION

The present invention is a rotary brushing tool and method of constructing the rotary brushing tool. The rotary brushing tool comprises a hub portion and a wheel portion. The hub portion has a pair of hub elements, where each hub element includes a central opening, an annular retaining plate portion that extends radially from the central opening, and a tubular portion that extends axially from the central opening. Placing the tubular portions of the hub elements in opposition forms a hub channel that extends radially from the central opening. The wheel portion includes bristles arranged in the hub channel to extend substantially radially from the central opening, and a castable material for retaining the bristles. Pouring the castable material into the hub channel and allowing it to cure, forms a hub that retains the bristles. An advantage of this approach is that it allows the entire hub area to be filled with bristles to give maximum fill density. This eliminates bare spots and gaps in the face of the brush, for example. In one embodiment, the hub channel substantially envelops the castable material before curing. In another embodiment, the hub channel substantially envelops the castable material after the curing process. The inner diameter of the tubular portion enables a user to secure the rotary brushing tool on an arbor.

In one embodiment, the tubular portion joins an inner circumference of the annular retaining plate portion. The connection further comprises a stepped portion and a flange. The stepped portion has an annular surface. The flange connects the stepped portion to the inner circumference of the annular retaining plate portion. An inner circumference of the annular surface joins the tubular portion.

In another embodiment, the annular retaining plate portion for each hub element further comprises a bead located on a side of the annular retaining plate portion inside the hub channel. The bead is operative to apply pressure to the bristles held in the hub channel and may connect to the outer circumference of the annular retaining plate portion. By applying pressure to the bristles, the bead increases the width of the bristles at the outer circumference of the wheel portion of the rotary brushing tool.

BRIEF DESCRIPTION OF THE DRAWINGS

The accompanying figures illustrate details of a method of making a rotary brushing tool having non-woven bristles that extend radially from a central hub which is constructed to have a one-piece integral structure with a consistent internal diameter. In the figures, elements that have like reference numbers and designations refer to like elements.

DETAILED DESCRIPTION OF THE INVENTION

Figure 1:
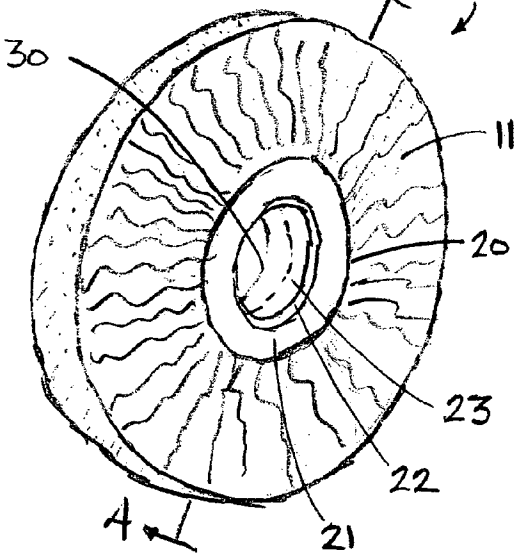
FIG. 1 is a perspective view depicting an embodiment of a rotary brushing tool constructed with a pair of hub flanges according to the invention.

As shown in FIG. 1, a rotary brushing tool 10 according to the invention comprises an annular wheel having a hub and bristles 11 that extend substantially radially from the hub. A pair of hub flanges 20, 30 bound the hub. Each hub flange forms one side of the hub. Each hub flange comprises an annular retaining plate portion 21, a stepped portion 22, and an axially extending cylindrical tubular portion 23. While the disclosed embodiments include a stepped portion 22 or 32 (see the discussion of FIG. 4), the stepped portion is not crucial to the invention and may be omitted if desired. In the latter case, the annular retaining plate would join the cylindrical tubular portion 23 or 33 directly and make a smooth, not stepped, transition to cylindrical tubular portion 23 or 33.

The hub of rotary brushing tool 10 preferably has a substantially cylindrical shape to facilitate the use of brushing tool 10 as a rotary tool. However, the shape of the hub may be adapted as required by the shape of the arbor, and may for example, be elliptical, square, hexagonal, etc. Thus, even though the invention description is in the context of a cylindrical rotary brushing tool, the invention can be readily adapted for other shapes as well. Preferably, the construction of the hub comprises embedding bristles 11 in a molded, curable epoxy resin or polymer material. In one embodiment, each individual bristle filament has a uniform length and is made of non-woven materials. However, other bristle configurations will be within the scope of the invention.

Figure 2A:
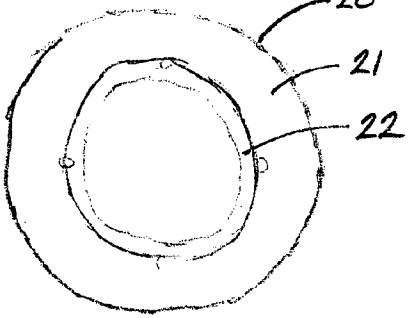
FIG. 2A and FIG. 2B are plan views of a hub flange shown in FIG. 1.
Figure 2B:
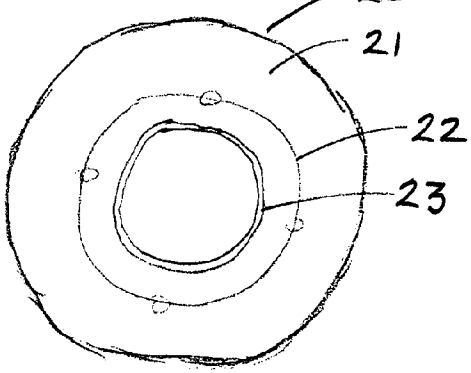

FIG. 2A and FIG. 2B are plan views of a hub flange shown in FIG. 1. FIG. 2A illustrates a plan view of hub flange 20 from the perspective of looking into the hub from the near side of rotary brushing tool 10. From this perspective, the only visible elements of hub flange 20 are annular retaining plate portion 21 and stepped portion 22. FIG. 2B illustrates a plan view of hub flange 20 from the perspective of looking from the opposite side of rotary brushing tool 10 to the exterior, near side of rotary brushing tool 10. From this perspective, the only visible elements of hub flange 20 are annular retaining plate portion 21, stepped portion 22, and axially extending cylindrical tubular portion 23.

Figure 3A:
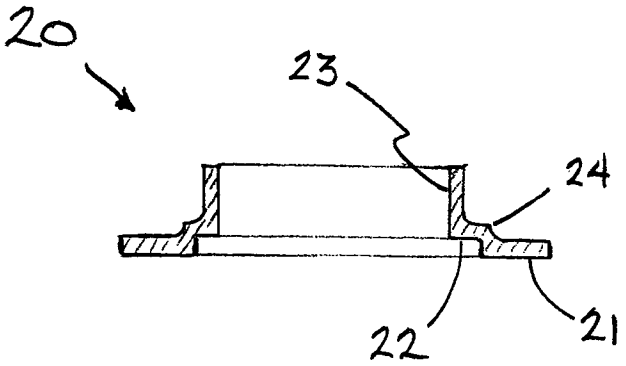
FIG. 3A is a cross-sectional view of one embodiment of a hub flange shown in FIG. 1.

FIG. 3A is a cross-sectional view of one embodiment of a hub flange shown in FIG. 1. Hub flange 20 shown in FIG. 3A comprises annular retaining plate portion 21, stepped portion 22, and axially extending cylindrical tubular portion 23. Annular retaining plate portion 21 includes an inner circumference and an outer circumference. A flange 24 on the inner circumference of annular retaining plate portion 21 connects annular retaining plate portion 21 to stepped portion 22. The surface plane of annular retaining plate portion 21 is substantially parallel to the surface plane of stepped portion 22. Stepped portion 22 includes an inner circumference and an outer circumference. The outer circumference of stepped portion 22 connects to flange 24 on the inner circumference of annular retaining plate portion 21. The inner circumference of stepped portion 22 connects to axially extending cylindrical tubular portion 23. The surface plane of axially extending cylindrical tubular portion 23 is substantially perpendicular to the surface plane of stepped portion 22.

Figure 3B:
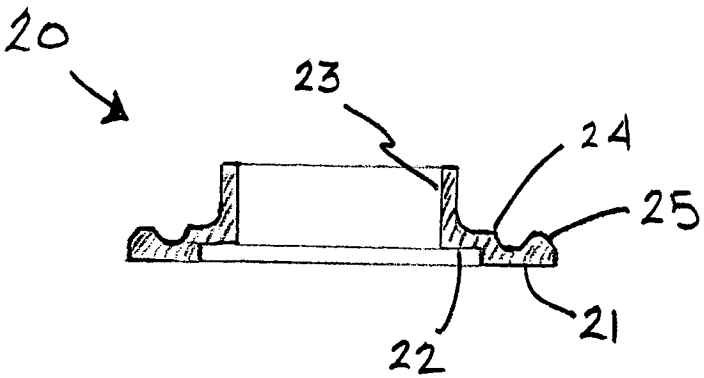
FIG. 3B is a cross-sectional view of another embodiment of a hub flange shown in FIG. 1.

FIG. 3B is a cross-sectional view of another embodiment of a hub flange shown in FIG. 1. Hub flange 20 shown in FIG. 3B comprises annular retaining plate portion 21, stepped portion 22, axially extending cylindrical tubular portion 23, and bead 25. Annular retaining plate portion 21 includes an inner circumference and an outer circumference. The outer circumference of annular retaining plate portion 21 connects to bead 25. Bead 25 is a raised surface on the inner wall of annular retaining plate portion 21 that slopes inwardly from the outer circumference of annular retaining plate portion 21 and inwardly from a point between the inner circumference and the outer circumference of annular retaining plate portion 21. A flange 24 on the inner circumference of annular retaining plate portion 21 connects annular retaining plate portion 21 to stepped portion 22. The surface plane of annular retaining plate portion 21 is substantially parallel to the surface plane of stepped portion 22. Stepped portion 22 includes an inner circumference and an outer circumference. The outer circumference of stepped portion 22 connects to flange 24 on the inner circumference of annular retaining plate portion 21. The inner circumference of stepped portion 22 connects to axially extending cylindrical tubular portion 23. The surface plane of axially extending cylindrical tubular portion 23 is substantially perpendicular to the surface plane of stepped portion 22.

Figure 4:
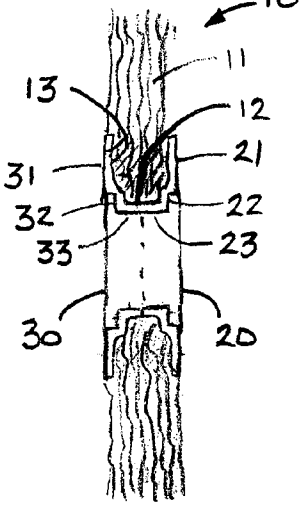
FIG. 4 is a cross-sectional view of the rotary brushing tool shown in FIG. 1, taken through line 4-4.

As depicted in FIG. 3B, bead 25 applies pressure on the bristles 11 held in the annular channel 12 (see the description of FIG. 4). When bead 25 is present, the cured epoxy or polymer material will hold the bristles 11 in a fanned out configuration and make rotary brushing tool 10 slightly wider at the outer circumference of the bristles 11 than at the hub 13. This is advantageous when a user needs a wider brush. Thus, the user of rotary brushing tool 10 can customize the brush by stacking several brushes axially, from hub-to-hub, to obtain a desired brush width. If the bristles 11 did not flare out at the outer circumference, there would be a gap caused by the hub flanges when stacking the brushes together. Flaring the bristles 11 outwardly effectively eliminates the gaps and provides the user with a wider brush with a continuous brushing surface having no gaps.

The pressure applied by bead 25 causes the bristles to fan out slightly at the outer circumference of rotary brushing tool 10. In one embodiment, an inward slope of 30 degrees from the surface plane of annular retaining plate portion 21 creates a raised surface for bead 25 that causes the bristles 11 to fan out sufficiently at the outer circumference of rotary brushing tool 10 to eliminate gaps when stacking multiple brushes. In another embodiment, an inward slope of 90 degrees from the surface plane of annular retaining plate portion 21 creates a flange surface for bead 25 that causes the bristles 11 to fan out sufficiently at the outer circumference of rotary brushing tool 10 to eliminate gaps when stacking multiple brushes. The flexibility, elasticity, and resiliency of bristles 11 determine the inward slope necessary to cause a fan-out of the bristles 11 at the outer circumference of rotary brushing tool 10.

FIG. 4 is a cross-sectional view of the rotary brushing tool shown in FIG. 1, taken through line 4-4. The cross-sectional view illustrates that an annular channel 12 substantially envelopes hub 13 and that bristles 11 extend substantially radially from hub 13. Thus, hub flange 20 substantially envelops the right side of hub 13 and hub flange 30 substantially envelops the left side of hub 13. Hub flange 20, as described in the discussion of FIG. 3A, comprises annular retaining plate portion 21, stepped portion 22, axially extending cylindrical tubular portion 23, and flange 24. Hub flange 30 comprises annular retaining plate portion 31, stepped portion 32, axially extending cylindrical tubular portion 33, and flange 34. The structure and function of the elements comprising hub flange 30 are similar to the corresponding elements of hub flange 20.

The method of constructing the hub flange comprises placing axially extending cylindrical tubular portion 23 in opposition to axially extending cylindrical tubular portion 33. Placing the axially extending cylindrical tubular portions 23, 33 in opposition forms an annular channel 12 that opens radially outward from rotary brushing tool 10. The method further comprises placing bristles 11 in annular channel 12, and casting an epoxy resin or other polymer material into the annular channel 12. In one embodiment, annular channel 12 substantially envelops the castable material before curing. In another embodiment, annular channel 12 substantially envelops the castable material after curing. Regardless, once cured, the epoxy resin or other polymer material holds the bristles 11 in place in the annular channel 12. The inner circumference of the annular channel 12 defines a central opening that allows a user to place rotary brushing tool 10 onto an arbor.

Adding hub flanges 20, 30 on the right and left side of rotary brushing tool 10 before casting the epoxy resin or other polymer material into the annular channel 12 holds the bristles 11 in place and determines the dimensions of hub 13 independent of the casting process. Since hub flanges 20, 30 are pre-made and not dependent on the cast epoxy or other polymer material, the diameter of the central opening formed by mounting the axially extending cylindrical tubular portions 23, 33 in opposition is always consistent. Furthermore, since the construction of pre-made hub flanges 20, 30 achieves much higher tolerances than a cast hub, a brush manufacturer can be assured that the internal diameter of every brush that uses the pre-made hub will be consistent, regardless of the epoxy resin or other polymer material used to encapsulate the bristles or of the curing conditions of the material.

Although the disclosed embodiments describe a fully functioning rotary brushing tool and method of construction to produce a rotary brushing tool having non-woven bristles that extend radially from a central hub, which is constructed to produce a one-piece integral structure with a consistent internal diameter, the reader, should understand that other equivalent embodiments exist. Since numerous modifications and variations will occur to those reviewing this disclosure, the rotary brushing tool and method of construction is not limited to the exact construction and operation illustrated and disclosed. Accordingly, this disclosure intends all suitable modifications and equivalents to fall within the scope of the claims.

What is claimed is:

1. A rotary brushing tool comprising:

a hub portion having a pair of hub elements, each hub element including a central opening bounded by a tubular portion extending axially along the central opening, an annular retaining plate portion extending radially outward from the, and a hub channel formed by placing the tubular portions of the hub elements in opposition, the hub channel opening radially outwardly; and a wheel portion including:

bristles arranged in the hub channel to extend substantially radially outward from the central opening so as to have a portion of the bristles within the hub channel and a portion of the bristles extending radially outward from the hub channel, a castable material retaining the bristles within the hub channel, the castable material being located substantially entirely within the hub channel and having an unbounded radially outward surface that is fully exposed to the portion of the bristles extending radially outward from the hub channel wherein the bristles are substantially free of the castable material radially outward from the huh channel so that the portions of the bristles radially outward from the hub channel are flexible relative to the portions of the bristles located within the castable material in the hub channel; and wherein the castable material is poured into the hub channel and, when cured, is retained in the hub channel solely by the hub elements and the portion of the bristles within the hub channel, the castable material forming a hub in the hub channel that retains the bristles.

2. The rotary brushing tool of claim 1, wherein the hub channel substantially envelops the castable material before curing.

3. The rotary brushing tool of claim 1, wherein the hub channel substantially envelops the castable material after curing.

4. The rotary brushing tool of claim 1, wherein an inner diameter of the tubular portion enables the rotary brushing tool to be secured on an arbor.

5. The rotary brushing tool of claim 1, wherein the tubular portion joins an inner circumference of the annular retaining plate portion.

6. The rotary brushing tool of claim 5, wherein a surface plane of the tubular portion is substantially perpendicular to a surface plane of the annular retaining plate portion.

7. The rotary brushing tool of claim 5, wherein the connection between the tubular portion and the inner circumference of the annular retaining plate portion further comprises a stepped portion having a circumferential annular surface extending radially outward with respect to the tubular portion, the circumferential annular surface being adjoined to, a flange extending axially inward with respect to the annular retaining plate portion; wherein the annular surface of the stepped portion and the flange are located within the hub channel.

8. The rotary brushing tool of claim 1, wherein the hub channel is an annular recess.

9. The rotary brushing tool of claim 1, wherein the castable material is an epoxy resin.

10. The rotary brushing tool of claim 1, wherein the rotary brushing tool has a one-piece integral structure.

11. The rotary brushing tool of claim 1, wherein the hub elements are joined to form the hub channel.

12. The rotary brushing tool of claim 1, wherein the annular retaining plate portion for each hub element further comprises a bead located on a side of the annular retaining plate portion inside the hub channel.

13. The rotary brushing tool of claim 12, wherein the bead is connected to the outer circumference of the annular retaining plate portion.

14. The rotary brushing tool of claim 12, wherein the bead is operative to apply pressure to the bristles held in the hub channel.

15. The rotary brushing tool of claim 14, wherein the applied pressure increases the width of the bristles at the outer circumference of the wheel portion.

* * * * *